US007685651B2

(12) United States Patent
Yoo

(10) Patent No.: US 7,685,651 B2
(45) Date of Patent: Mar. 30, 2010

(54) GIRDLE UNDERWEAR FOR MEN

(76) Inventor: Dae-kyu Yoo, Ssangyong Apt 205-1402, Gonjiam-li 457, Silchon-eup, Gwangju-si, Gyeonggi-do 464-756 (KR)

( * ) Notice: Subject to any disclaimer, the term of this patent is extended or adjusted under 35 U.S.C. 154(b) by 292 days.

(21) Appl. No.: 11/720,173

(22) PCT Filed: Dec. 21, 2005

(86) PCT No.: PCT/KR2005/004419

§ 371 (c)(1),
(2), (4) Date: May 24, 2007

(87) PCT Pub. No.: WO2006/078091

PCT Pub. Date: Jul. 27, 2006

(65) Prior Publication Data

US 2008/0010725 A1 Jan. 17, 2008

(30) Foreign Application Priority Data

Jan. 21, 2005 (KR) ..... 10-2005-0005976

(51) Int. Cl.
*A41B 9/00* (2006.01)

(52) U.S. Cl. ..... 2/403; 2/400

(58) Field of Classification Search ..... 2/400, 2/403, 228, 238; 450/94, 97, 100, 104, 114, 450/115, 122–124, 131, 151
See application file for complete search history.

(56) References Cited

U.S. PATENT DOCUMENTS 3,877,439 A * 4/1975 Locascio ..... 450/123
4,173,976 A * 11/1979 Bloomquist et al. ..... 602/67
4,416,272 A * 11/1983 Nelkin ..... 128/95.1
4,476,895 A * 10/1984 Shibusawa ..... 450/122
4,984,304 A * 1/1991 Brown ..... 2/401
5,611,722 A * 3/1997 Osborne ..... 450/99
5,888,118 A * 3/1999 Kishi ..... 450/122
5,954,564 A * 9/1999 Ganz ..... 450/99
6,287,169 B1 * 9/2001 Willms et al. ..... 450/101

* cited by examiner

*Primary Examiner*—Gloria Hale
(74) *Attorney, Agent, or Firm*—Park & Associates IP Law LLC

(57) ABSTRACT

An undergarment for men is formed with multiple layers of fabric materials attached together. A first fabric piece (10) is formed in a brief shape to have a front part (10*c*), a rear part (10*d*), a pair of side parts (10*e*) extending between the front and rear parts (10*c*, 10*d*), and a bottom part (10*f*) extending between a lower portion of the front part (10*c*) and a lower portion of the rear part (10*e*), the front part (10*c*) having a first elastic thread line (14) attached by stitching or sewing to a central area of the front, bottom, and rear parts (10*c*, 10*f*, 10*e*) to exert a suitable elastic force a genitalia region of the wearer. A second fabric piece (20) is attached externally to the first fabric piece (10), wherein the second fabric piece has a belt-like shape extending in a circumferential direction and covering a substantial portion of the first fabric piece (10) but not covering a central portion of the front part of the first fabric piece. A third fabric piece (30) is attached externally to the first and second fabric pieces (10, 20), wherein the third fabric piece is formed in a partial brief configuration having a front part, a rear part, a pair of side parts extending between the front and rear parts, and a bottom part extending from a lower portion of the front part and having a free end, in a shape such that, when attached to the first and second fabric pieces, the front and side parts cover substantially an entire area of the front and side parts of the first fabric piece, respectively, the rear part covers an upper portion of the rear part of the first fabric piece, and the bottom part covers substantially an entire area of the bottom part of the first fabric piece. The third fabric piece (30) preferably includes a second elastic thread line (32) attached by stitching or sewing to a central area of the front part of the third fabric piece.

12 Claims, 6 Drawing Sheets

(a)

(b)

(c)

(a)

(b)

(c)

GIRDLE UNDERWEAR FOR MEN

REFERENCE TO RELATED APPLICATIONS

This is a continuation of pending International Patent Application PCT/KR2005/004419 filed on Dec. 21, 2005, which designates the United States and claims priority of Korean Patent Application No. 10-2005-0005976 filed on Jan. 21, 2005.

FIELD OF THE INVENTION

The present invention relates to a girdle underwear for men, and more particularly to a girdle underwear for men which presses projecting parts of the groin area of a male human body, that is, the genitalia, with appropriate pressure to render a smooth and agreeable look so that, when the man wears tight trousers, the silhouette of the genitalia gives a slim appearance, thereby removing repugnance due to the projection of the genitalia.

BACKGROUND OF THE INVENTION

As is well known in the art, an underwear for men represents clothing, which is worn between the skin and outer trousers. In most cases, the underwear is worn to cover and protect the genitalia of a human body or in an effort to maintain a temperature of the human body. Recently, underwears with nice and fancy designs have been developed using various fabrics and patterns.

Specifically, these days, in conformity with social changes, many men enjoy wearing tight trousers to improve their appearances. When wearing these tight trousers, the configuration of the man's underwear is considered to playing an important role since the figure of the human body is determined by the functionality of an underwear.

SUMMARY OF THE INVENTION

In the conventional underwear for a man, since the parts, except the front part corresponding to the genitalia of a man's body, is constituted by a single ply of fabric and this piece is made of a mixture of cotton and spandex, when the underwear is worn, it improperly exerts pressure on the genitalia and the buttocks of the man's body. Consequently, the genitalia and the buttocks pressed in this manner cannot be appropriately exposed to air circulation, which hinders the normal operation of the blood circulatory system, thereby adversely influencing the function of the genitalia of the man's body.

Also, in the conventional underwear for a man, because the elasticity of the underwear is dispersed in all directions, the underwear cannot press the projecting parts of the genitalia with appropriate pressure, and cannot properly support the genitalia. Therefore, when men wear tight trousers while wearing the underwear, the silhouette of the genitalia does not give a smooth appearance, and repugnance is provoked due to the projection of the genitalia.

Accordingly, the present invention has been made keeping in mind the above problems occurring in the prior art, and an object of the present invention is to provide a girdle underwear for men, in which a fabric piece serving as a girdle is superposed on a fabric piece serving as underpants, elastic fiber lines are stitched to the center portions of the front and rear parts of the pieces, and another fabric piece made of a cushioning material is partially intervened between the two pieces, such that the projecting parts of a man's genitalia are reliably held in place and pressed to form a slow curve, thereby giving a slim and aesthetic silhouette of the genitalia.

In order to achieve the above object, the present invention provides a girdle underwear for men, comprising a first fabric piece formed with leg openings and a waist band and having a first elastic fiber line which is stitched to center portions of a front part, a rear part, and a bottom part of the first fabric piece; a second fabric piece externally attached to left and right portions of the front part and upper portions of the rear part and side parts of the first fabric piece; and a third fabric piece stitched to the first fabric piece such that the third fabric piece covers the entire front part and upper portions of the rear part and the side parts of the first fabric piece, with the second fabric piece placed between the first and third fabric pieces, and having a second elastic fiber line which is stitched to a center portion of a front part of the third fabric piece.

The girdle underwear for men according to the present invention has a complicated multi-structure in that a first fabric piece serving as underpants having good elasticity and a third fabric piece serving as a girdle having good elasticity are coupled with each other, second and fourth fabric pieces having good cushionability are partly placed between the first and third fabric pieces, and first and second elastic fiber lines are stitched to the center portions of the front parts of the first and third fabric pieces to apply increased elasticity to corresponding parts of the human body. As a consequence, advantages are provided in that the projecting parts of a man's pubes, such as the genitalia, can be reliably held in place, and, when the man wears tight trousers, the silhouette of the genitalia can be improved to form a gradual curve, thereby giving a slim appearance of the man's genitalia.

DETAILED DESCRIPTION OF THE INVENTION

Figure 1:
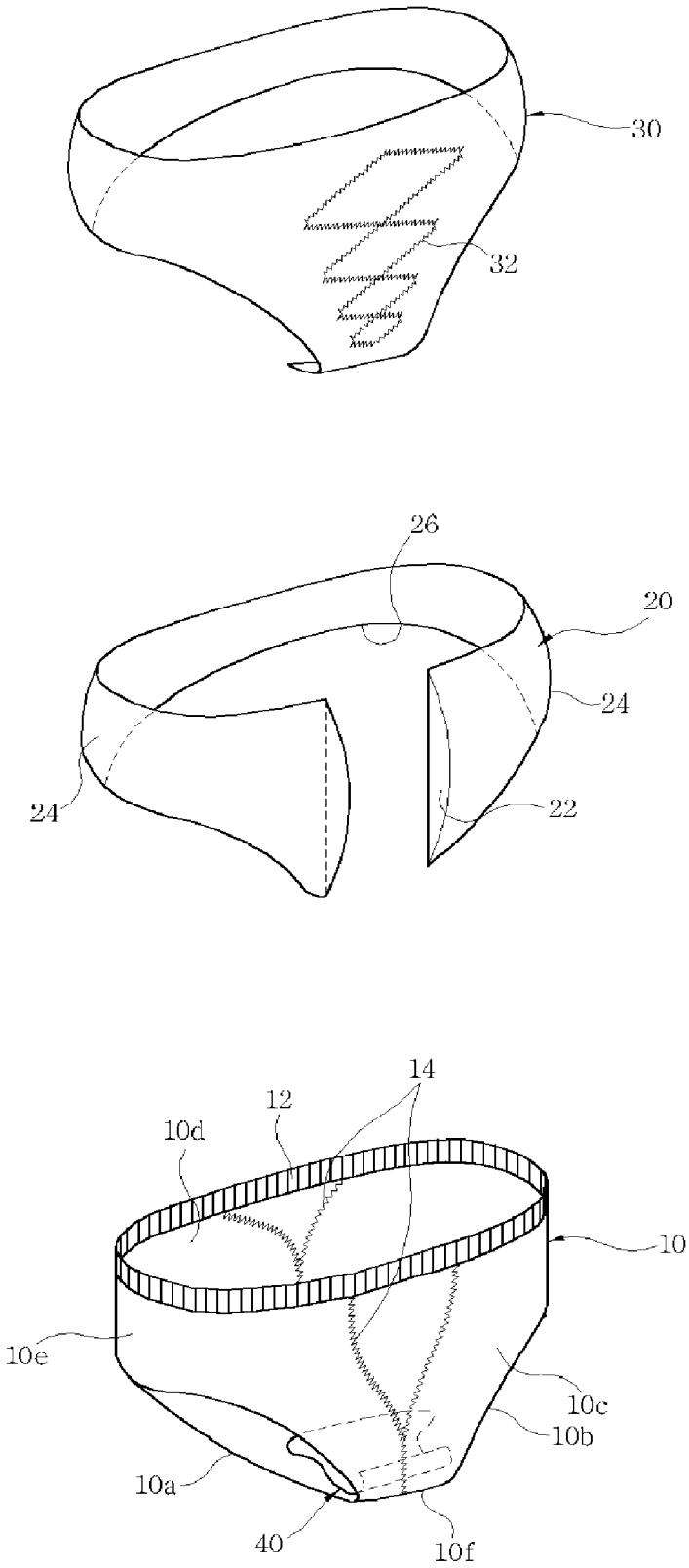
FIG. 1 is exploded perspective views illustrating a girdle underwear for men in accordance with an embodiment of the present invention.

Hereafter, an embodiment of the present invention will be described with reference to FIGS. 1 through 7.

A girdle underwear for men in accordance with an embodiment of the present invention includes a first fabric piece 10, a second fabric piece 20, a third fabric piece 30 and a fourth fabric piece 40. The first fabric piece 10 has leg openings 10*a*, 10*b* and a waist band 12 to serve as underpants. The first fabric piece 10 further has a first elastic fiber line 14 which is stitched to the center portions of a front part 10*c*, a rear part 10*d* and a bottom part 10*f* of the first fabric piece 10. The second fabric piece 20 has a belt-shaped configuration and is externally attached to the left and right portions of the front part 10*c* and the upper portions of the rear part 10*d* and side parts 10*e* of the first fabric piece 10 to aesthetically correct the body line of a user, which is defined by the waist, the buttocks, the genitalia, and so forth. The third fabric piece 30 is stitched to the first fabric piece 10 such that the third fabric piece 30 covers the entire front part 10*c* and the upper portions of the rear part 10*d* and the side parts 10*e* of the first fabric piece 10, with the second fabric piece 20 serving as a girdle intervened between the first and third fabric pieces 10, 30. The third fabric piece 30 has a second elastic fiber line 32 which is stitched to the center portion of the front part of the third fabric piece 30. The third fabric piece 30 is made of a material having high elasticity. The fourth fabric piece 40 has the shape of a pad and is attached to the inner surface of the center portion of the bottom part 10*f* of the first fabric piece 10 to aesthetically correct the body line of the perineal region of the user.

Concretely speaking, the first fabric piece 10 has the shape of bikini briefs, which comes into direct contact with the skin of the human body. The first fabric piece 10, except the waist band 12, is made of an elastic material which is a mixture of cotton and spandex.

The second fabric piece 20 is made of sponge-based cushioning material. The second fabric piece 20 has a cut-away portion 22, with a predetermined width, which is formed at the front part of the second fabric piece 20 so as not to cover the first elastic fiber line 14 stitched to the center portion of the front part 10*c* of the first fabric piece 10, a protruding part 24 which gradually decreases in curvature from the middle portion toward the upper and lower ends of the second fabric piece 20, and a narrow part 26 which corresponds to the upper portion of the rear part 10*d* of the first fabric piece 10 and gradually decreases in width toward the center portion of the rear part 10*d* of the first fabric piece 10.

The third fabric piece 30 faces the entire front part 10*c*, the upper portions of the side parts 10*e* and the rear part 10*d*, and the bottom part 10*f* of the first fabric piece 10. The third fabric piece 30 is made of spandex-based material having high elasticity. The edges of the third fabric piece 3 are stitched to the first fabric piece 10 with the second fabric piece 20 intervened between the first and third fabric pieces 10, 30.

The fourth fabric piece 40 is made of sponge-based cushioning material. The fourth fabric piece 40 is formed such that, when viewed from the top, the portion adjacent to the anus is wider than the portion adjacent to the scrotum. The fourth fabric piece 40 is attached to the bottom part 10*f* of the first fabric piece 10 to be positioned close to the anus.

The first elastic fiber line 14 has one side portion which is stitched to the first fabric piece 10 in such a way as to be divided into two line segments at the upper end of the front part 10*c* of the first fabric piece 10 such that the two line segments are joined into one line segment after extending through a predetermined height, and the one line segment extends to the lower end of the front part 10*c* of the first fabric piece 10, the other side portion which is stitched to the first fabric piece 10 in such a way as to be divided into two line segments at the upper end of the rear part 10*d* of the first fabric piece 10 such that the two line segments are joined into one line segment after extending through a predetermined height and the one line segment extends to the lower end of the rear part 10*d* of the first fabric piece 10, and a middle portion which is stitched to the first fabric piece 10 in such a way as to connect the lower ends of the front part 10*c* and the rear part 10*d* of the first fabric piece 10, and extends along the center portion of the bottom part 10*f* of the first fabric piece 10.

The two lines segments of the first elastic fiber line 14 are stitched to the first fabric piece 10 such that the width between the two line segments is no greater than the width between the leg openings 10*a*, 10*b*. The one line segment of the first elastic fiber line 14 is stitched to the first fabric piece 10 such that the one line segment passes over the center lines of the genitalia and the perineal region, and between the buttocks.

Figure 3:
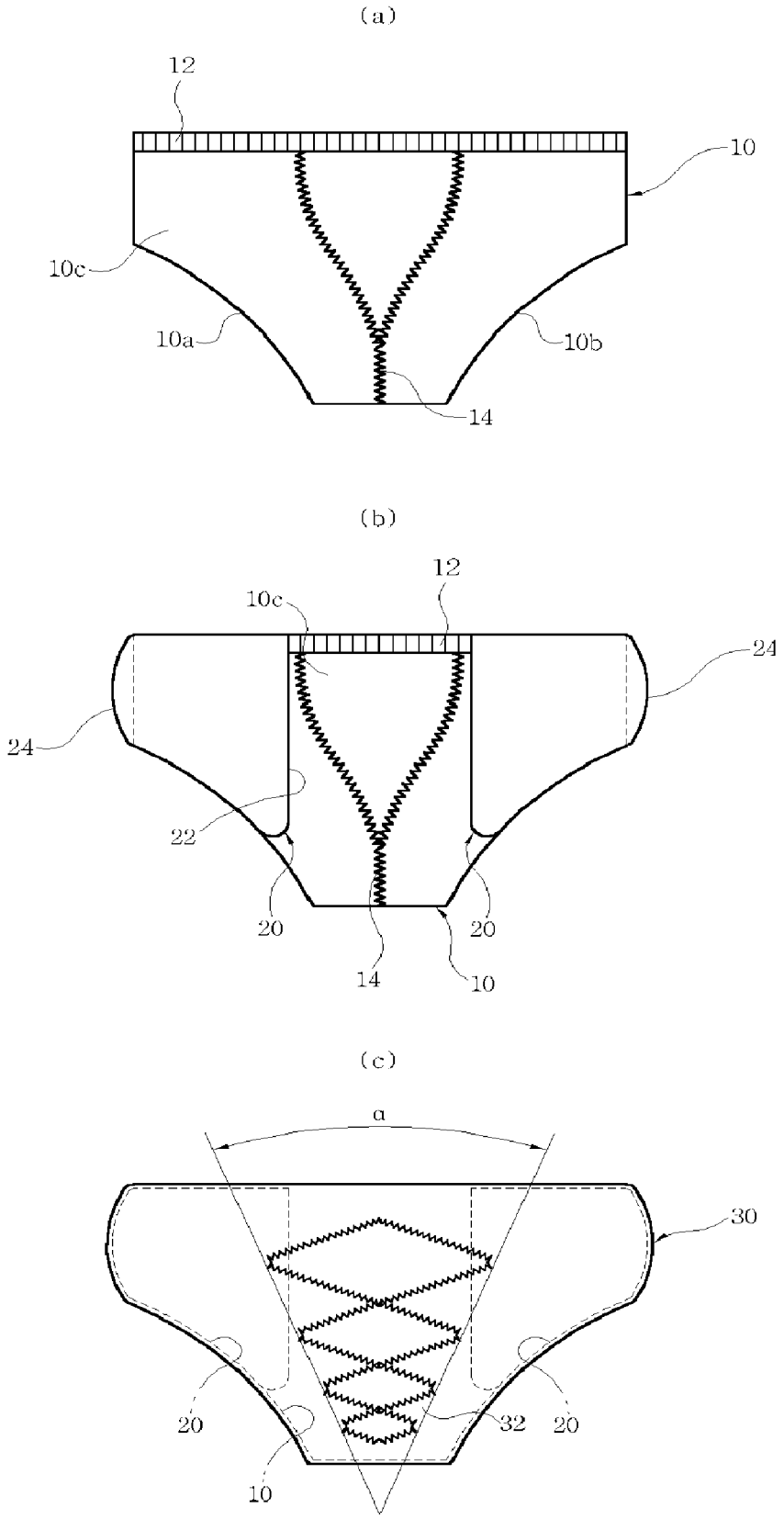
FIG. 3 is front views illustrating the manufacturing steps of a girdle underwear for men according to the present invention.
Figure 4:
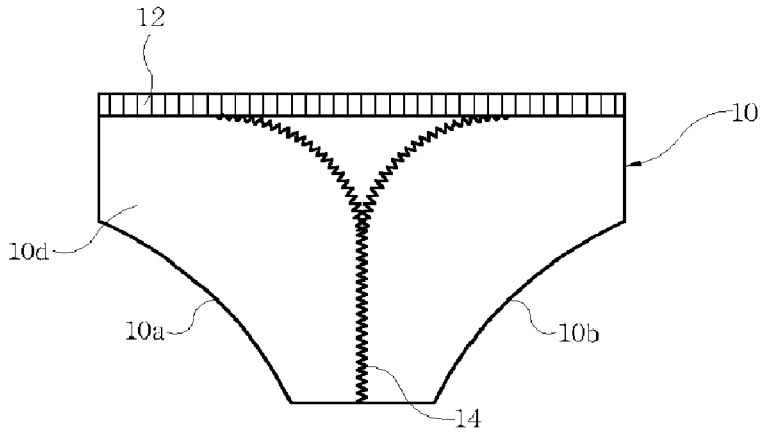
FIG. 4 is rear views illustrating the manufacturing steps of a girdle underwear for men according to the present invention.
Figure 4:
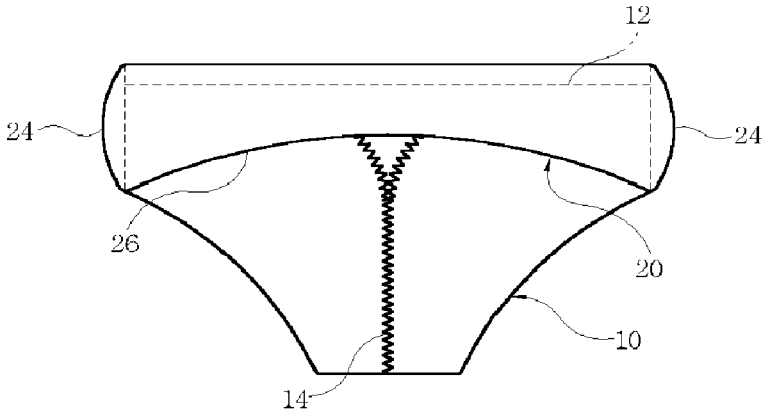
Figure 4:
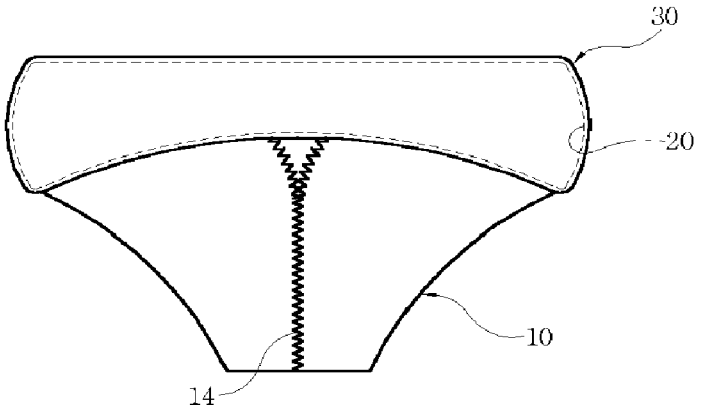
Figure 5:
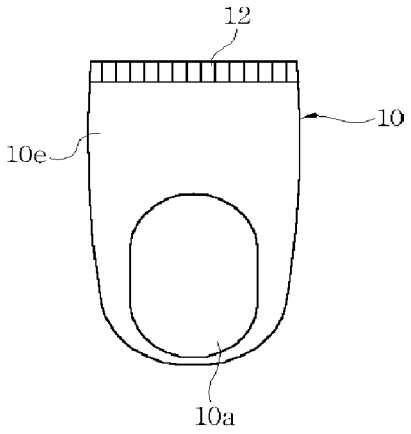
FIG. 5 is side views illustrating the manufacturing steps of a girdle underwear for men according to the present invention.
Figure 5:
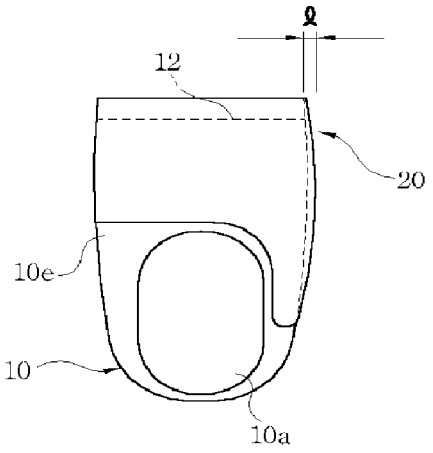
Figure 5:
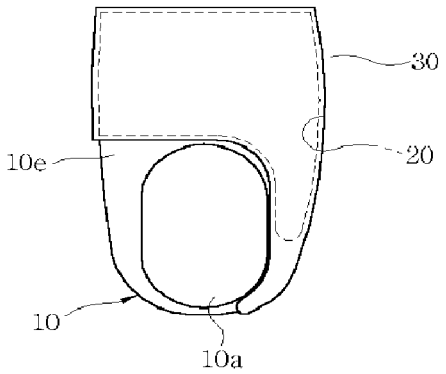
Figure 6:
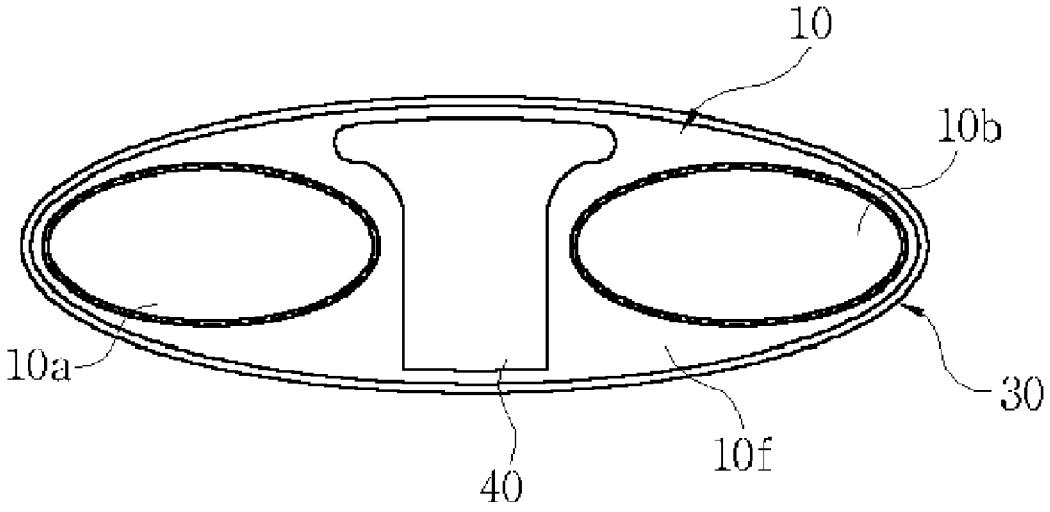
FIG. 6 is a plan view illustrating a girdle underwear for men according to the present invention.
Figure 7:
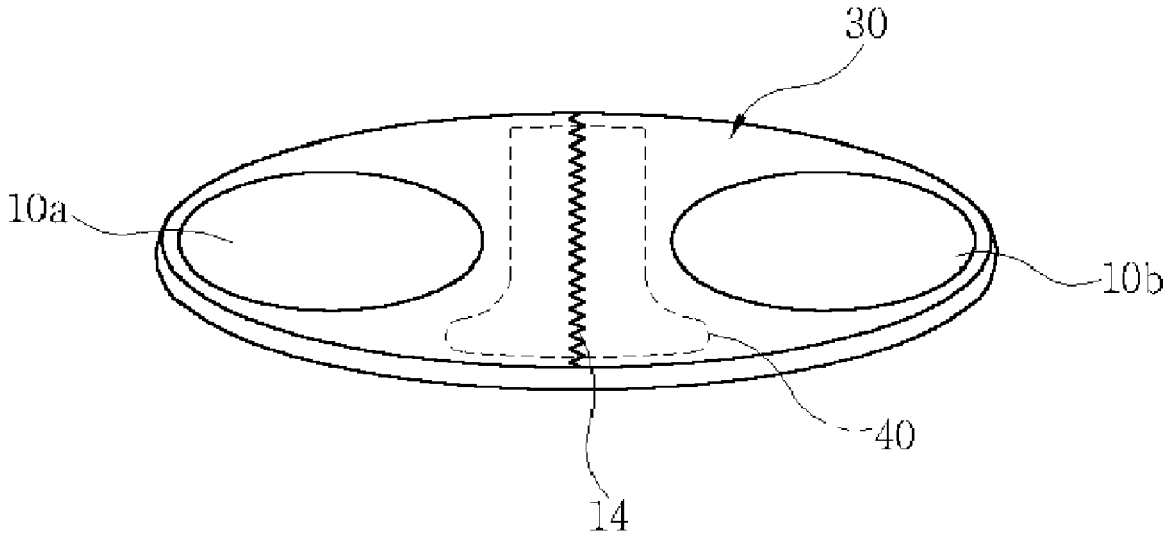
FIG. 7 is a bottom view illustrating a girdle underwear for men according to the present invention.

The second elastic fiber line 32 is stitched to the center portion of the front part of the third fabric piece 30 to have a configuration in which a plurality of diamonds gradually decreasing in size in a downward direction are connected with one another as shown in FIG. 3(*c*). At this time, it is preferred that, when connecting both transverse ends of respective diamonds using two longitudinal lines, the angle '$\alpha$', defined by the two longitudinal lines, has a V-shaped configuration.

The first and second elastic fiber lines 14, 32 are made of yarn having high elasticity such that the first and second fiber lines 14, 32 can be respectively zigzag stitched to the first and third fabric pieces 10, 30 in their lengthwise direction and in an elastically compressed state.

Hereafter, working effects of the girdle underwear for men according to the present invention constructed as mentioned above will be described.

Figure 2:
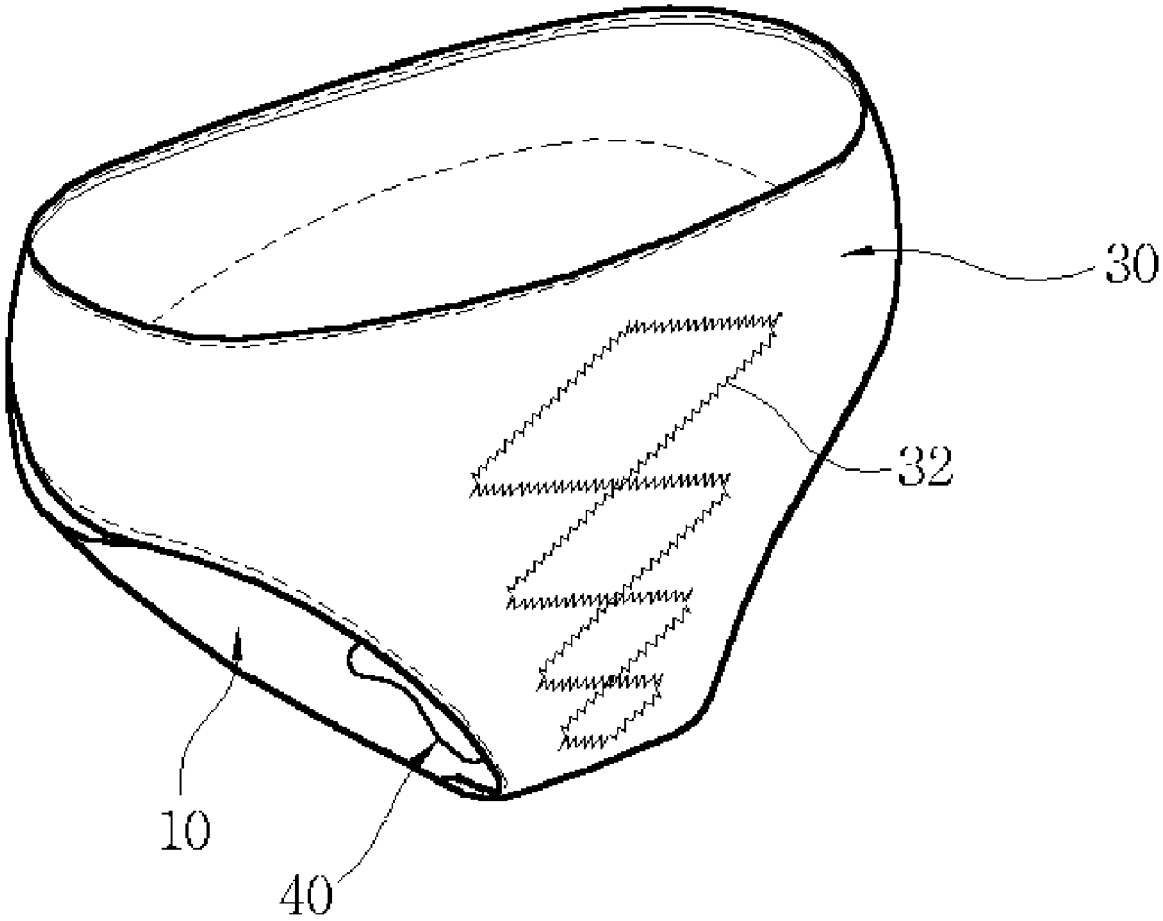
FIG. 2 is a perspective view illustrating a coupled state of a girdle underwear for men according to the present invention.

When a user wears the girdle underwear for men as shown in FIG. 2, the upper portion of the first elastic fiber line 14, which is stitched to have two line segments extending from the upper end to the height-wise middle of the front part 10*c* of the first fabric piece 10, applies elastic force to the penis when the penis is directed upwards between the two line segments. Further, the lower portion of the first elastic fiber line 14, which is stitched to have one line segment extending from the height-wise middle to the lower end of the front part 10*c*, applies elastic force to the scrotum such that the left and right portions of the scrotum are divided by the one line segment.

That is to say, the front portion of the first elastic fiber line 14 which is placed on the front part 10*c* of the first piece 10 functions to compress the front part 10*c* of the first fabric piece 10 against the reaction force by the genitalia. Accordingly, due to the elasticity of the first elastic fiber line 14 which is stitched to the center portion of the front part 10*c* of the first fabric piece 10 to have the shape of a Y, the front part 10*c* of the first fabric piece 10 is prevented from bulging outward and presses the genitalia with appropriate pressure. As a consequence, the genitalia are prevented from moving leftward or rightward and also from interfering with each other.

Further, the first elastic fiber line 14, which passes over the center portions of the bottom part 10*f* and the rear part 10*d* of the first fabric piece 10, compresses the rear part 10*d* and the bottom part 10*f* of the first fabric piece 10 against the reaction force by the genitalia.

In other words, the first elastic fiber line 14 in the rear part 10*d* of the first fabric piece 10 contracts along the portion which divides the buttocks, to compress the buttocks with appropriate pressure, so that sagging of the buttocks supported by the rear part 10*d* of the first fabric piece 10 is minimized. The first elastic fiber line 14 in the bottom part 10*f* of the first fabric piece 10 compresses the genitalia and the perineal region and applies appropriate pressure to the scrotum supported by the bottom part 10*f* of the first fabric piece 10.

Meanwhile, when wearing the girdle underwear for men, according to the present invention, the second fabric piece 20 which is attached to the outer surface of the front part, the side parts and the rear part of the first fabric piece 10, and the fourth fabric piece 40 which is attached to the inner surface of the bottom part of the first fabric piece 10, function to smoothly and beautifully correct the body line which is defined by the genitalia, the groin area, the perineal region, the buttocks, the waist, and so forth. Thus, when the user wears tight trousers, a silhouette can be improved and a slim appearance can be rendered.

The cut-away part 22, which is formed at the center portion of the front part of the second fabric piece 20 to have the predetermined width, holds the genitalia not to be moved leftward or rightward. Further, the cut-away part 22 prevents the genitalia from projecting beyond the thickness T of the cut-away part 22 as shown in FIG. 3(*b*) so that the height of the protruding part 24 of the second fabric piece 20 is maintained in the same height as the genitalia to improve the silhouette.

The fourth fabric piece 40 prevents the first fabric piece 10 from being introduced into the perineal region, the anus and the region between the buttocks and distributes the pressing force applied to the genitalia by the elasticity of the first and third fabric pieces 10, 30 to improve the wearing feeling of the girdle underwear for men according to the present invention.

The third fabric piece 30 applies elastic force to the first fabric piece 10 via the second fabric piece 20 so that the first fabric piece 10 can be closely pressed against the human body. By this elastic force, the body line of a user can match the natural line of the girdle underwear for men according to the present invention.

To further improve the silhouette, The second elastic fiber line 32 stitched to the center portion of the front part of the third fabric piece 30 functions to further press the protruding reaction of the genitalia, which was not pressed by the first fabric piece 10.

Although preferred embodiments of the present invention have been described for illustrative purposes, those skilled in the art will appreciate that various modifications, additions, and substitutions are possible, without departing from the scope and spirit of the invention as disclosed in the accompanying claims.

What is claimed is:

1. An undergarment for men, comprising:

a first fabric piece formed in a brief shape to have a front part, a rear part, a pair of side parts extending between the front and rear parts, and a bottom part extending between a lower portion of the front part and a lower portion of the rear part, and defining two leg openings to receive the legs of a wearer there-through, the front part having a first elastic thread line attached by stitching or sewing to a central area of the front, bottom, and rear parts to exert an elastic force in a genitalia region of the wearer;

a second fabric piece attached externally to the first fabric piece, the second fabric piece having a belt-like shape extending in a circumferential direction and covering a substantial portion of the first fabric piece but not covering a central portion of the front part of the first fabric piece; and a third fabric piece attached externally to the first and second fabric pieces, the third fabric piece formed in a partial brief configuration having a front part, a rear part, a pair of side parts extending between the front and rear parts, and a bottom part extending from a lower portion of the front part and having a free end, in a shape such that, when attached to the first and second fabric pieces, the front and side parts cover substantially an entire area of the front and side parts of the first fabric piece, respectively, the rear part covers an upper portion of the rear part of the first fabric piece, and the bottom part covers substantially an entire area of the bottom part of the first fabric piece.

2. The undergarment as set forth in claim 1, wherein the second fabric piece is made of a cushioning material.

3. The undergarment as set forth in claim 1, wherein the second fabric piece has a cut-away portion formed at free ends of the front part so as not to cover the first elastic thread line attached to the central area of the front part of the first fabric piece.

4. The undergarment as set forth in claim 1, wherein the third fabric piece is made of spandex.

5. The undergarment as set forth in claim 1, wherein the first elastic thread line is attached to the central area of the front part of the first fabric piece is divided into two line segments at an upper end of the front part such that the two line segments are joined into one line segment after extending to a predetermined height and the one line segment extends to a lower end of the front part, the first elastic thread attached to the central area of the rear part is divided into two line segments at an upper end of the rear part such that the two line segments are joined into one line segment after extending to a predetermined height and the one line segment extends to a lower end of the rear part, and the one line segments of the front and rear parts are connected to each other by the first elastic thread line attached to the central area of the bottom part of the first fabric piece.

6. The undergarment as set forth in claim 1, wherein a pad-shaped fourth fabric piece is attached to a center portion of the bottom part of the first fabric piece.

7. The undergarment as set forth in claim 6, wherein the fourth fabric piece is made of a cushioning material.

8. The undergarment as set forth in claim 1, wherein the third fabric piece includes a second elastic thread line attached by stitching or sewing to a central area of the front part of the third fabric piece.

9. The undergarment as set forth in claim 8, wherein the second elastic thread line has a configuration in which a plurality of diamonds gradually decreasing in size in a downward direction are connected to one another.

10. The undergarment as set forth in claim 9, wherein the first and second elastic thread lines are made of yarn having high elasticity and in a zigzag-shaped pattern.

11. The undergarment as set forth in claim 1, wherein the first fabric piece includes a waist band disposed at an upper portion thereof.

12. The undergarment as set forth in claim 1, wherein the second fabric piece has a dimension generally decreasing from the free ends of the front part toward the center portion of the rear part.

* * * * *